United States Patent [19]

Patthey

[11] 3,952,943

[45] Apr. 27, 1976

[54] APPARATUS FOR SWAGING THE MOVEMENT CONTROL BELTS FOR CONTROLLING OPERATING GROUPS OF A KNITTING MACHINE

[75] Inventor: Michel Patthey, Couvet, Switzerland

[73] Assignee: Edouard Dubied et Cie (Societe Anonyme), Couvet, Switzerland

[22] Filed: Jan. 10, 1975

[21] Appl. No.: 539,988

[30] Foreign Application Priority Data

Jan. 14, 1974 Switzerland ..... 444/74

[52] U.S. Cl. ..... 234/116; 234/128

[51] Int. Cl.[2] ..... G06K 1/02

[58] Field of Search ..... 234/51, 111, 116, 128

[56] References Cited

UNITED STATES PATENTS

| | | | |
|---|---|---|---|
| 3,090,550 | 5/1963 | S'ervillat | 234/111 X |
| 3,215,244 | 11/1965 | Hickerson | 234/111 X |

*Primary Examiner*—J. M. Meister

*Attorney, Agent, or Firm*—Hume, Clement, Brinks, Willian, Olds & Cook, Ltd.

[57] ABSTRACT

An apparatus for swaging the movement control belts for controlling the operational groups of a knitting machine comprising a punching bar, a die, punches, a punch bearing plate, entrainment means, a movement control belt, punch selection means, and a selector keyboard.

9 Claims, 15 Drawing Figures

Fig. 2
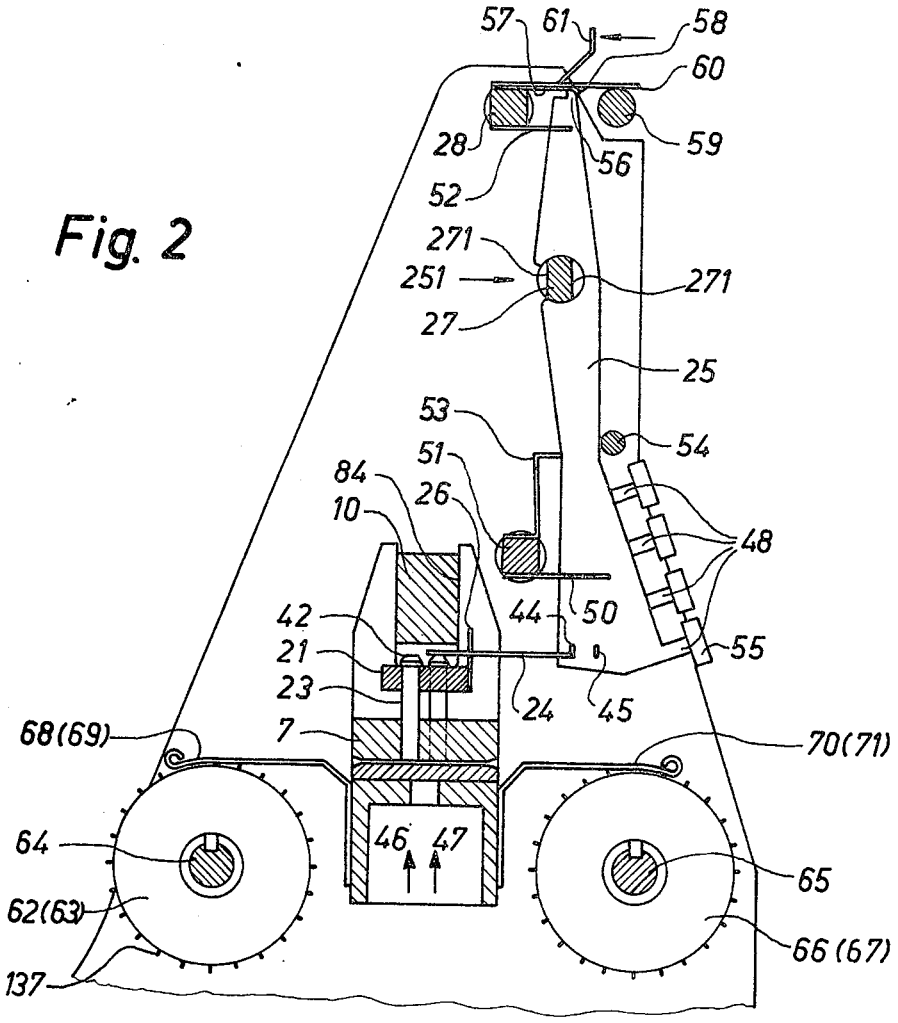
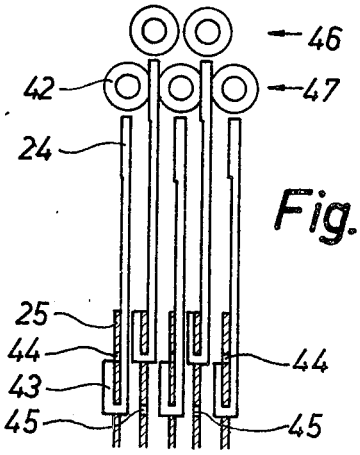
Fig. 3a
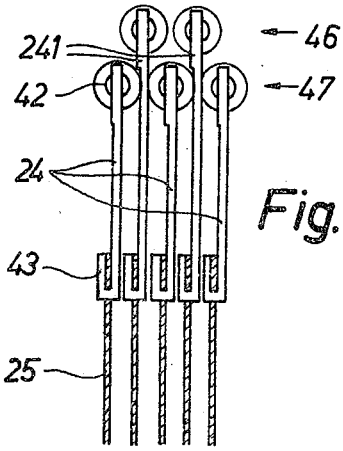
Fig. 3b

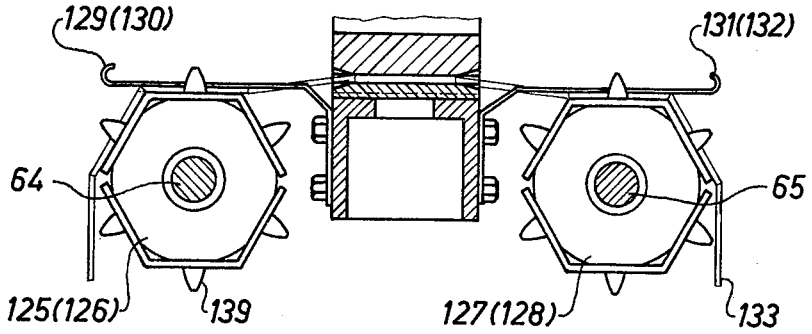
Fig. 11
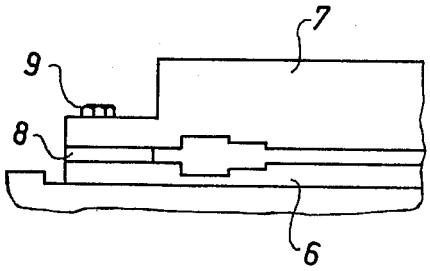
Fig. 12
Fig. 13a
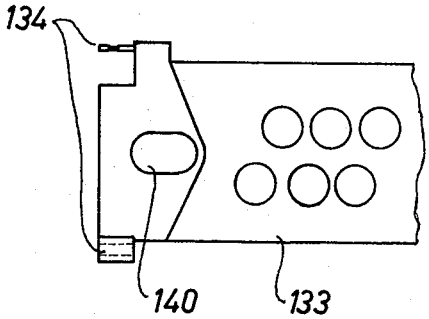
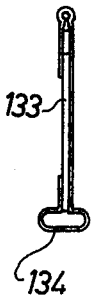
Fig. 13b

APPARATUS FOR SWAGING THE MOVEMENT CONTROL BELTS FOR CONTROLLING OPERATING GROUPS OF A KNITTING MACHINE

The present invention relates to an apparatus for swaging the movement control belts for the control of the operational groups of a knitting machine, comprising a punching bar, a die, punches, a punch bearing plate, entrainment means, a movement control belt, punch selection means and a selector keyboard.

Movement control belts are known already in the art and their preparation is made manually by a hammer, a punch and a positioning and guiding template of the punch.

The movement control belts are valid only for one single type of product and the always increasing number of types of products requires a higher and higher number of different movement control belts.

Because the knitting machines become more and more complex and the selection of the operations becomes greater and greater, it is no longer economically feasible to hand-swage these movement control belts.

The objective of the invention is to create a simple machine making it possible to prepare movement control belts more easily and more rapidly and also to reduce the larger and larger number of swaging templates due to the high number of the different types of knitting machines.

The apparatus for swaging movement control belts for the control of operating groups of a machine for knitting, according to the invention, is characterized by the fact that for each one of the possible perforations arranged over at least one row of a movement control belt there is a punch which is free from any mechanical attachment, that a selector corresponds to each punch, which may be pivoted on its axis of rotation into at least two positions which it maintains by memory means constituted by a spring comb, each tooth of said spring comb acting on at least one of the selectors, that memorized selectors are cancelled individually and/or by operations, that each function requiring one or more selectors, and/or such cancellation is total by cancellation means which are manual, independent of a swaging cycle, and/or automatic depending on a swaging cycle, that a selection bar corresponds to each selector which materializes the selection, that all, part of, or none of the perforations constituting on a movement control belt, at least one group of functions and arranged on at least one row and over the entire length of the die and the punch holder plate, result from one single swaging cycle, that the step by step advance of a movement control belt during one swaging cycle is adjustable by entrainment means in at least two different sizes, that at least one of the entrainment means wheels is movable on a shaft, in at least two different positions allowing for the swaging of at least two types of movement control belts of different widths, and that the posting of the keys making up the selector keyboard is identical for several types of movement control belts.

Preferably, the axis of rotation of the selectors is thinned by the machining of two symmetrical and diametrically opposite sides, the selector bars are curved at one end, the cancellation or erasure means of the memorized functions are constituted by tongues, each related on one or several of the teeth of a spring comb constituting the memorization means, the memorized functions can be erased manually by erasure keys and/or automatically by a system of connecting rods mounted on eccentric cams, which in turn form one piece with a swage cycle control shaft, the die and the punch holder plate have transverse grooves allowing for the passage of the assembly means of movement cardboards which constitute the movement control means, a serrated wheel, forming one piece with a shaft of the entrainment means, positions by means of a serrated lever, the position of a movement belt and in relation to the die, and the selector keys of memorized and non-memorized functions form at least two different planes on the keyboard, thus permitting a visual control of the memorized functions.

The attached drawing exemplifies an embodiment of the movement control belt swaging apparatus for the control of function groups of a knitting machine, the object of the invention.

FIG. 2 is a cross-section view.

FIG. 3*a* is a partial top view of the punches, in a non-selected position of the selectors, on a larger scale.

FIG. 3*b* is a partial top view of the selectors, and represents a variant of the selection shafts, on a larger scale.

Figure 4:
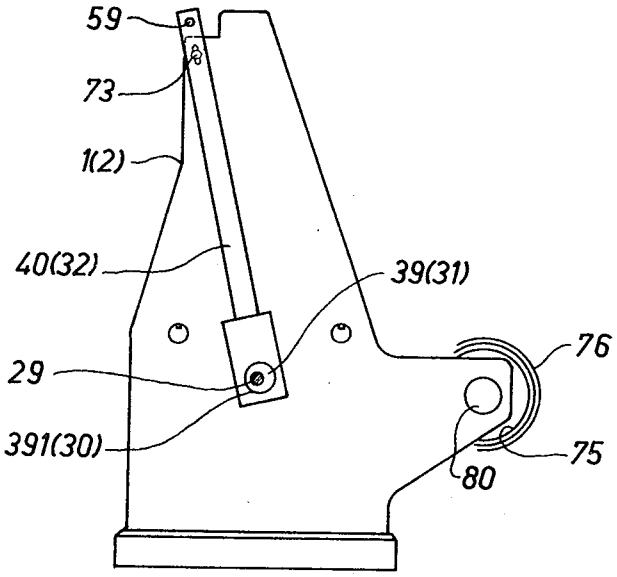

FIG. 4 is a lateral view showing only part of the components making up this side of the swaging apparatus.

Figure 5:
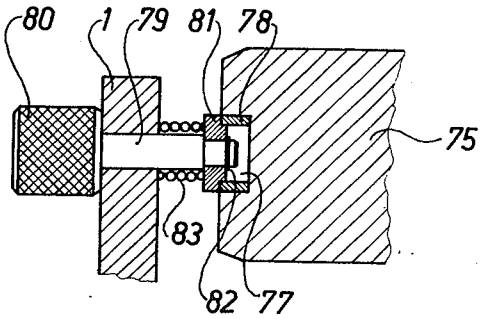

FIG. 5 is a sectional view of the fixation means of the storage drum.

Figure 6:
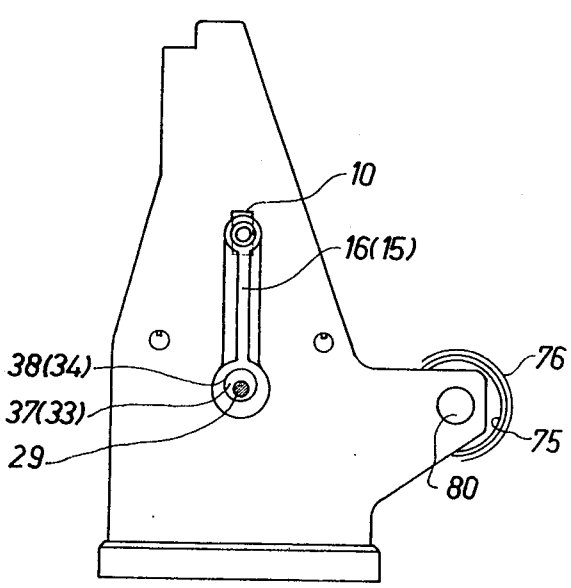

FIG. 6 is a lateral view representing only part of the components making up this side of the swaging apparatus.

Figure 7:
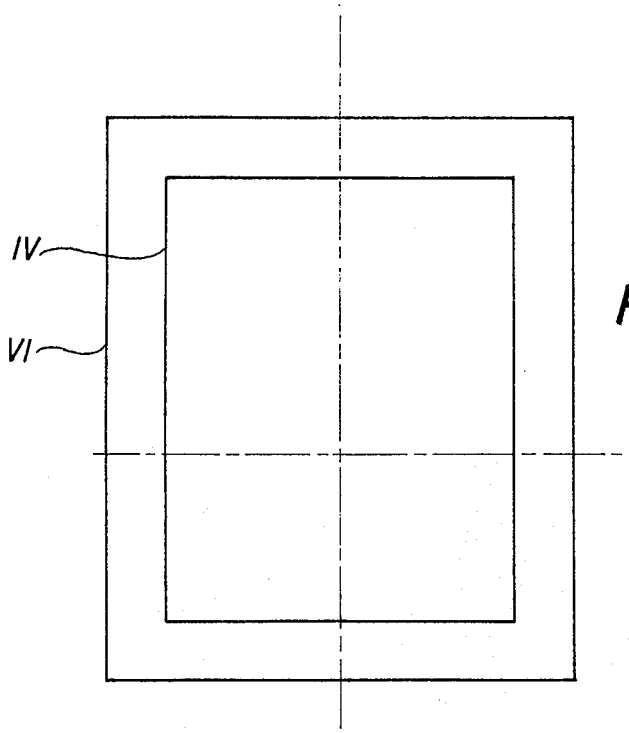

FIG. 7 is a representation of the superposition of FIGS. 4 and 6 showing one complete side of the swaging apparatus.

Figure 8:
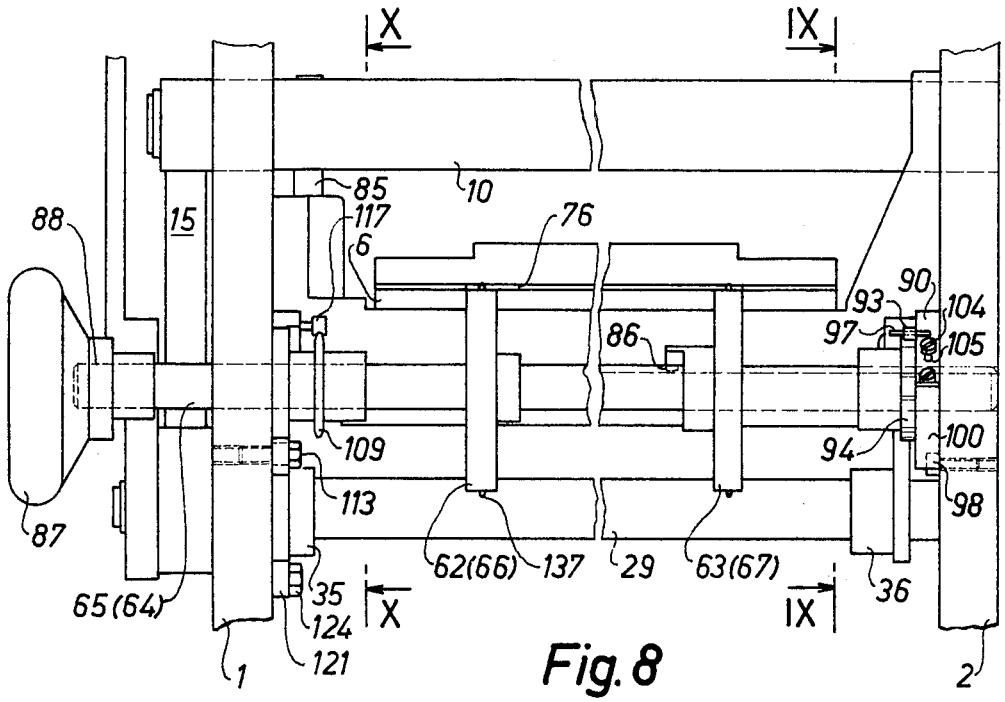

FIG. 8 is a front view, partly in section, of the entrainment system of the movement control belts.

Figure 9:
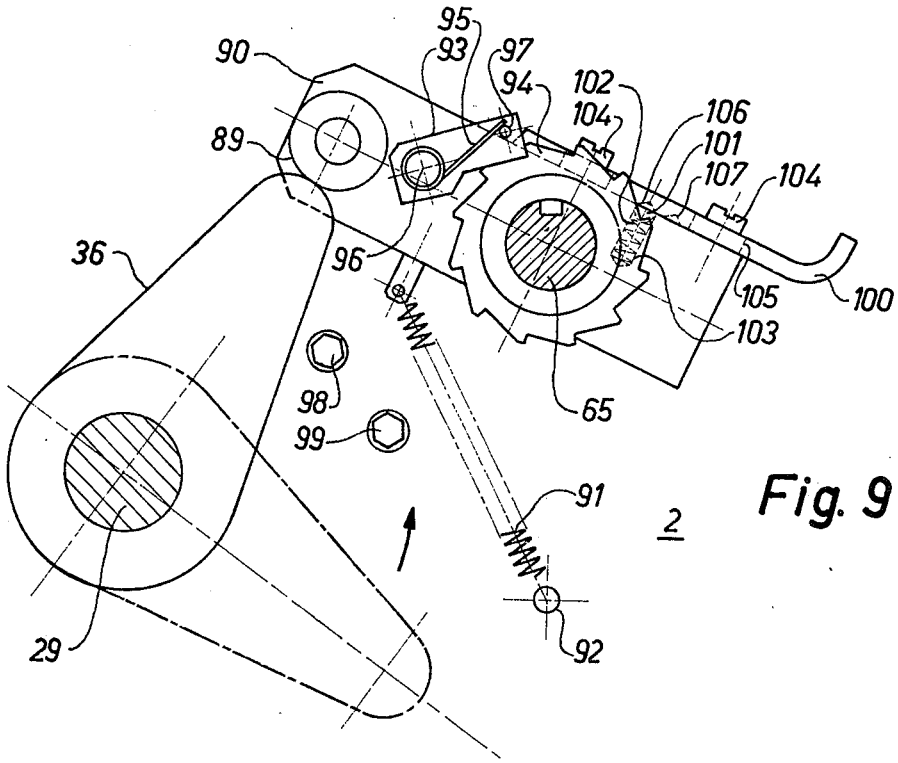

FIG. 9 is a partial view, along IX—IX of FIG. 8, on a larger scale.

Figure 10:
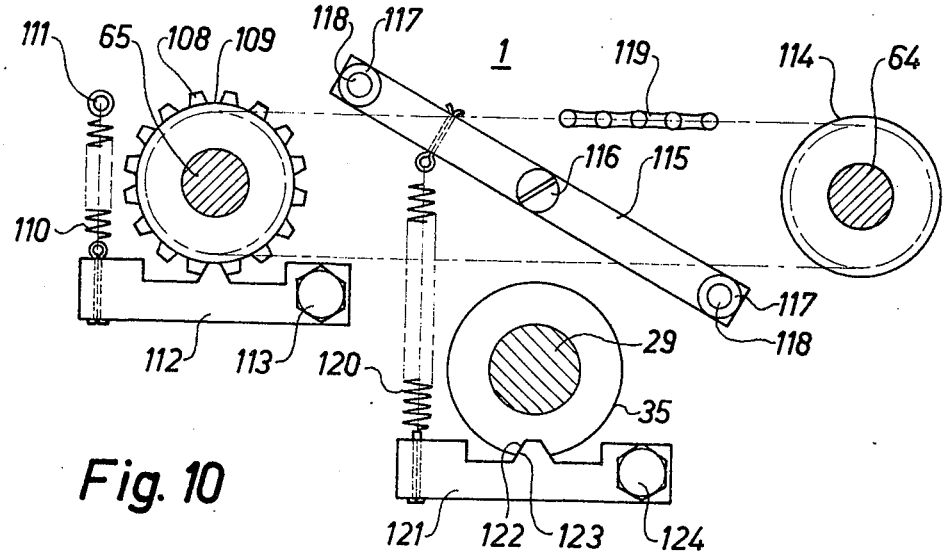

FIG. 10 is a partial view, along X—X of FIG. 8, on a larger scale.

FIG. 11 is a partial sectional view of a variant of the system of entrainment.

Figure 1:
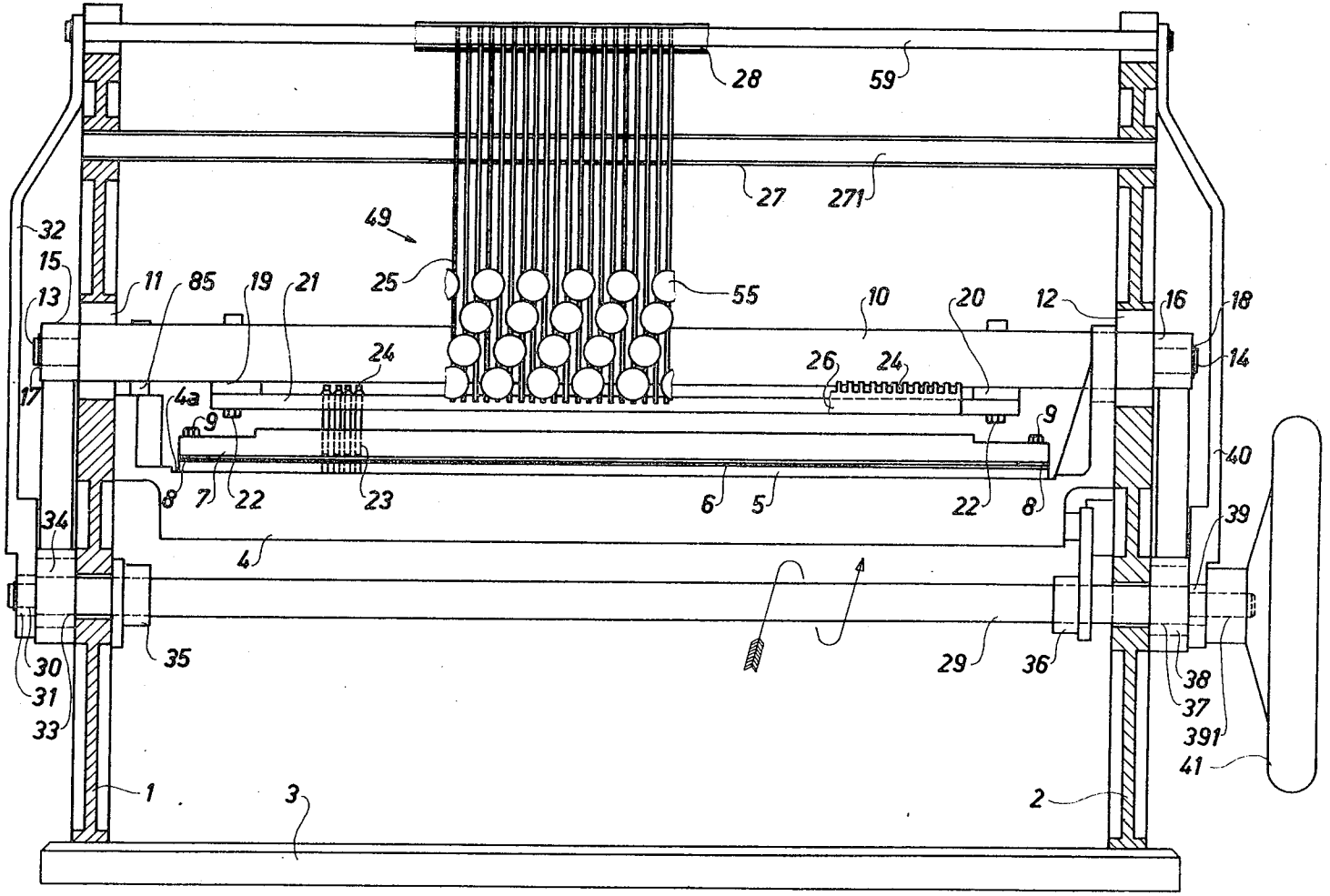
FIG. 1 is a front view, partly in section, of the swaging apparatus from which we removed some parts, to facilitate the understanding.

FIG. 12 is a partial front view of a detail of FIG. 1.

FIG. 13*a* is a partial view of a member which may constitute a movement control belt.

FIG. 13*b* is a cross-section view showing the control belt and hooking means.

Lateral supports 1, 2, arranged parallel to each other and perpendicular to the plane determined by the base 3 form one piece with said base 3.

The cradle 4 is fixed between the lateral supports 1, 2 and the plane determined by its frontal upper side 4 is approximately parallel with the plane formed by the base 3. The empty space necessary for the passage of the movement control belts, which we shall call movement belts, located between the die 6, which is related to an anvil 5, and the punch guide plate 7 is in function of the thickness of the beams 8. The die 6, the punch guiding plate 7 and the beams or girders 8 form one piece with the cradle 4 by fixation means 9.

The stop bar 10 passes through the supports 1 and 2 from one side to the openings 11 and 12. The connecting rods 15 and 16 are mounted on the ends 13 and 14 of the stop bar 10, so that they may have a rotary movement in a plane perpendicular to the axis of the stop bar 10, without communicating this movement to the stop bar 10, and they are positioned on the stop bar 10 longitudinally by their position between the safety washers 17 and 18, placed in grooves located on the ends 13, 14 of the stop bar 10 and the lateral supports 1 and 2.

The girders or crosspieces 19 and 20 allow for an adjustment of the distance provided between the punch carrying plate 21 and the stop bar 10. The fixation means 22 render the punch carrying plate 21 and the girders 19, 20 to form one piece with the stop bar 10. A selection rod 24 is associated with each one of the punches 23, arranged regularly on at least one row and distributed in a regular fashion over the entire length of the punch guide plate 7, if there are several rows. Each selection shaft forms one piece with a selector 25. These rods are aligned, guided and separated from each other by a comb 26 fastened to the punch carrier plate 21. The pitch of this comb is equal to the quotient of the pitch measured between two combs 23 of one and the same row (for example 46 or 47) (FIG. 2 and FIG. 3) divided by the number of rows of punches, two rows in this embodiment. The shaft 27 supports all the selectors 25 and forms one piece with the side supports 1, 2. The thinning of the shaft 27 over its entire length, by machining of two diametrically opposite sides 271 and the opening 251 (FIG. 2) of the selectors 25 will permit an installation and dismantling by only a rotation by about 90° of the selector 25 about the shaft 27. The shaft 28 is part of a memorization and erasure system of the memorized functions which shall be described in connection with FIGS. 2 and 4.

The control shaft 29 passes through the swaging apparatus from one side to the other. An eccentric 31 which coacts with a connecting rod 32 is mounted on a bearing surface of said control shaft; an eccentric 34 which coacts with a connecting rod 15 is mounted on a bearing surface 33 inside the lateral support 1, a serrated wheel 35 forming one piece with this control shaft 29, inside the lateral support 2, a cam 36, also forming one piece with said control shaft, on the outside of the lateral support 2, on a bearing surface 37, an eccentric 38 coacting with a connecting rod 16, on a bearing surface 391, an eccentric 39 coacting with a connecting rod 40 and a control flywheel 41 also forms one part with the control shaft 29. The functioning of all these parts is described according to the figures relating to them.

FIG. 2 represents a cross-section of FIG. 1 and shows the selection means of the swaging apparatus.

The vertical movement of the punches 23 is limited by the fact that their heads strike downward, against the punch carrier plate 21 and upward against the stop bar 10 or against a selection rod 24. The punches 23 are guided on the one hand by the punch carrier plate 21 and on the other hand by the punch guide plate 7.

Each selection rod 24 is placed by its end in the shape of a hook 43 (FIG. 3*a*) in an opening 44 or 45 of the selector 25, depending on whether this rod is assigned to a punch 23 of a rear row 46 or a front row 47, and guided between the stop bar 10 and the punch carrying plate 21, at its other end by the comb 26. All selectors are of the same model, but three of the four lugs 48 are eliminated according to the positions of the keys 55 mounted on one of the lugs 48, on the keyboard 49 (FIG. 1). The selectors 25 mounted on shaft 27 are separated from each other, on the one hand by the comb 50 mounted on the shaft 51 and on the other hand by the comb 52 mounted on shaft 28. The spring comb 53, likewise mounted on the shaft 51 makes it possible to bring each selector back independently, into a so-called "non-selected" position, striking against a transverse shaft 54.

A pressure exerted on the key 55 of a selector 25 causes this selector to pivot about the shaft 27, readies a tooth of the spring comb 53 and, by means of a proboscis 56, lifts a tooth of the spring comb 57 which constitutes the mechanical memory of the swaging apparatus. The spring comb 53 then moves the selector 25 back until a hook 58 of one of the teeth of the spring comb 57 strikes against the proboscis 56 of said selector which then is in a position called "selected." That way, the selection tooth 24 in question is between the stop bar 10 and the punch 23, selection of which was desired. This selection prevails until the bar 59, the operation of which is described below, lifts the tongues 60 which form one piece with one or several teeth of the spring comb 57, so that the hook 58 releases the proboscis and the selector 25, under the action of one of the teeth of the spring comb 53 is returned to its non-selected position. The selection also may be erased by a thrust in the direction indicated by the arrow on one or several of the erasure keys 61, which likewise form one piece with one or several of the tongues 61 and thus with one or several teeth of the spring comb 57. If an operation requires several keys, for example, it is also possible, as long as only one erasure key 61 is forming one piece with one single tongue 60 and all the teeth of the spring comb 57 corresponding to this operation, to erase an erroneous selection by operating another key 55 of this same function.

The entrainment wheels 62, 63 and 66, 67 form one piece with shafts 64 and 65 respectively and operate in synchronization. The safety rods 68, 69, 70 and 71 assure the entrainment and position of the movement belts on the entrainment wheels 62, 63, 66, 67 by means described in relation with FIG. 11. The synchronism and the feed system are described in relation with FIGS. 8, 9 and 10.

The non-selected position of the selection rods 24, shown in FIG. 3*a* shows the position of these selection rods in relation to each punch 23, that is at each punch head 42, and their position in either one of the openings 44, 45 of the selectors 25. This is one solution where all the selection rods are identical and the shifting of the rows of punches 46, 47 is compensated by the interstice of the openings 44, 45.

In FIG. 3*b* the shifting of the two rows of punches 46, 47 is compensated for example by the difference of length of the selection rods 24 and 241 and each hook 43 of each of these selection rods passes by the opening 44 (FIG. 2) of the corresponding selector 25. This figure shows the selected position of the selector, that is to say, the position of the selection rods in relation to the punch head 42. The length of the curved end of the hook 43 is smaller than the length of the openings 44, 45 (FIG. 2) of the selectors 25, so that one single rotation of about 90° allows for the assembly of selection rods 24 with the selectors 25.

The erasure system of the memorized functions shown in FIG. 4 (see also FIG. 1) comprises an eccentric 39 (31 of the other side of the swaging apparatus and symmetrical with the one described there), shown on a bearing surface 391 (30) of the control shaft 29 and forming one piece with the latter, placed in a connecting rod 40 (32). One rotation of this eccentric imparts a back and forth movement of this connecting rod, which is guided by a pivot 73 placed in the lateral support 1 (2) and traversing an opening of this connecting rod. Each ascending movement of this connecting rod 32 (40) permits by means of the bar 59 forming one piece with the connecting rods 32 and 40 the erasure of the memorized functions in a manner already described.

The swaging movement belts 76 are stored on a storage drum 75 which is fastened between the lateral supports 1 and 2 as shown in FIG. 5.

A peg 78 is located in each release 77, one at each end of the storage drum 75. Each lateral support, 1, 2, is traversed freely by a shaft 79, so that the head 80 of this shaft is outside the swaging apparatus. A peg 81 arranged in rows and mounted freely on the shaft 79 is held by a safety washer 82. The compression spring 83, mounted on the shaft 79 holds, by its action against the inside of the lateral support 1 (2) on the one hand, and against the peg 81 arranged in rows on the other hand, said peg arranged in rows against the peg 78. The storage drum 75, thus mounted between the two lateral supports 1 and 2 may be changed rapidly by simple traction of the shaft heads 80 to be replaced a new storage drum which bears a new movement belt. The hooking of both movement belts is well known and will not be described within the scope of this application.

The partial view of one side of the swaging apparatus of FIG. 6 is symmetrical to what a view of the other side could represent and it is not shown. The references in brackets thus define the symmetrical parts located on the other side. On a bearing surface 37 (33) located at the end of the control shaft 29 an eccentric 38 (34) is mounted, forming one piece with the control shaft on which a connecting rod 16 (15) is mounted. Each complete rotation of the control shaft 29 causes a vertical back and forth movement of the stop bar 10 which is guided transversely, on the control fly wheel side 41, by the opening 84 (FIG. 2) of the cradle 4, and on the other side by the peg 85 (FIG. 1) forming one piece with the cradle 4 and placed vertically in relation to the upper side 4*a*. This peg also assures the longitudinal positioning of said stop bar.

The superposition of FIGS. 4 and 6 showing the same side of the apparatus for swaging is shown schematically in FIG. 7.

The entrainment means for the movement belts 76 is shown in the front in FIG. 8. The entrainment wheels 62, 66 are mounted in one piece with the shafts 64 and 65 respectively. The entrainment wheels 63, 67 are movable radially on the shafts 64 and 65 respectively so that the spacing of two pairs of wheels 62, 63 and 66, 67 can be adapted to the width of the movement belts 76, but they follow the movements of rotation of the shafts 65 and 64 respectively by the engagement of a longitudinal groove of the corresponding shaft. The guided shaft 64 is lodged by one of its ends in the lateral support 1 and by the other end in the lateral support 2. The shaft 65 is lodged by one of its ends in the lateral support 2 and transverses the lateral support 1. The flywheel 87, forming one piece with the end 88 of the driving shaft 65 allows for the manual control of the advancing or recoil of the movement belts 76. The entrainment of these movement belts is assured by tenons 137, placed regularly on the circumference of each of the entrainment wheels 62, 63, 66, 67, which engage into openings 140 placed in the edging of the movement belts. The number and shape of these tenons may vary depending on the type of movement belt to be prepared.

The forwarding system of the movement belts 76, shown in FIG. 9, may be described in the following manner. For each complete rotation of the control shaft 29, the cam 36, forming one piece with said control shaft also describes a complete rotation in the direction indicated by the arrow. While effecting its rotation, the cam 36 meets on its trajectory a pivot 89 forming one piece with a lever 90 pivoting freely about the driving shaft 65 and pulled back constantly, when the pivot 89 is outside the thrust of cam 36, in a starting position, by means of the traction spring 91, fastened on the one hand to the lever 90 and on the other hand to the tenon 92 forming one piece with the lateral support 2. It impresses on this lever 90 a rotary movement about the driving shaft 65. The ratchet 93, still in contact with the ratchet wheel 94 by the action of a torsion spring 95, mounted on the shaft 96 of the ratchet 93 and forming one piece with the lever 90, on a peg 97, traversing the ratchet or pawl 93 from one side to the other, entrains the ratchet wheel 94, forming one piece with the driving shaft 65, and by that the shaft 65 until the pivot 89 is placed outside its trajectory by the cam 36. The lever 90, pulled back by the spring 91, the pawl 93 slides on the teeth of the ratchet wheel 94, until the lever 90 strikes against the stop screw 98 or 99, if the screw 98 is eliminated, to increase the advance of the apparatus. The lever 100 makes it possible to put the pawl 93 out of operation for a possible rotation called rearward from the driving shaft 65. The lever 100, held in position by a connecting rod 101 which is thrust by a spring 102 located in a release 103, is guided by the screws 104 fastened to the lever 90 and passing through the grooves 105 of lever 100, it can be thrust until the connecting rod 101 passes from the engagement 106 to the disengagement 107. Then the lever 100 urges the peg 97, prepares the torsion spring 95 and maintains the pawl 93 outside the range of the ratchet wheel 94. The driving shaft thus can be operated freely in either direction by the flywheel of FIG. 8.

The synchronism of the two shafts 64, 65 and the position called "start" of the swaging apparatus are described in relation with FIG. 10. Any rotation imposed manually by the flywheel 87 (FIG. 8) or by the feeder system represented in FIG. 9, on the shaft 65 entrains the cogwheel 108 and the chain wheel 109, which form one piece with this shaft and are located inside the lateral support 1. One rotation of the cog wheel 103 tensions a traction spring 110 which forms one piece with the lateral support 1 by the pivot 111 and on the other hand, with a positioning lever 112 mounted pivotingly about the screw 113, which in turn, forms one piece with the lateral support 1 by the action of one of its teeth on the tooth of the positioning lever. The number of teeth of the cog wheel 108 is equal to or a multiple of the number of teeth of the ratchet wheel 94 (FIG. 9) and defines the position of the shafts 64, 65, that is to say with the aid of the entrainment wheels 62, 63, 66, 67 and of the tenons or lugs 137 (FIG. 2) the position of the movement belt 76 (FIG. 4) in relation to the die 6 (FIG. 1), as well as the advance of this movement belt. A greater advance or feed can be applied for example by the rotation of this cog wheel divided in half, that is the feed system causes the cog wheel to advance or rotate by two teeth in relation to the positioning lever 112.

The chain wheel 109 transmits the rotation of the driving shaft 65 to the driven shaft 64 with the aid of the chain wheel 114, forming one piece with the driven shaft 64 and located inside the lateral support 1 and by means of the chain 119. The stretcher 115 pivots in its center about a shaft 116 forming one piece with the lateral support 1 and seated by its rollers 117 mounted pivotingly on the shafts 118 which in turn form one piece with the stretcher 115, each at one end, against the chain 119 under the action of a traction spring 120 which is fastened by one of its ends on the stretcher 115 and by the other end on a positioning lever 121. The shaft 116 of this stretcher is mounted between the chain wheels 109, 114, and the rotary movement imposed on the stretcher by the traction spring 120 causing the roller to be seated symmetrically opposite on the chain 119, which has the effect of eliminating the play from the chain and thus of assuring a perfect synchronism of both shafts 64 and 65. The serrated wheel 35, forming one piece with the control shaft 29, determines by the engagement of its notch 122 on the proboscis 123 of the positioning lever 121, mounted pivotingly on a shaft 124, forming one piece with the lateral support 1, the starting position of the swaging apparatus, that is the position which makes it possible to effect a selection on the keyboard 49 (FIG. 1).

The operation of the swaging apparatus can be described as follows:

In the starting position, the tooth 123 of the positioning lever 121 is in engagement with the notch 122 of the serrated wheel 35 (FIG. 10). By the position of the eccentrics 34, 38 on the control shaft 29 (FIG. 6) the stop bar 10 is in a position called "high." The selectors 25 (FIG. 2) are in the non-selected position and the cog wheel 108 is engaged by one of its cogs on the tooth of the positioning lever 112 (FIG. 10). The lever 100 (FIG. 9) of the feed system is in a position called "in operation." The connecting rods 32, 40 (FIG. 4) are already in a descending movement, due to the fact that the position called "high" of the eccentrics 31, 39 is approximately 90° in advance on the position called "high" of the eccentrics 34, 38 (FIG. 6), thus the bar 59 (FIG. 2) no longer is in contact with the tongues 60 of the system for the erasure of the memorized functions. The selection can be chosen by applying pressure on one or several of the keys 55 of the keyboard 49 (FIG. 1). By imposing on the flywheel 41 a rotary movement in the direction indicated by the arrow, the eccentrics 34, 38 (FIG. 6) impose a descending movement on the stop bar 10, the eccentrics 31, 39 (FIG. 4) continue the descending movement of their connecting rods. All punches 32 start to descend and are still held by their head 42 and the punch holder plate 35. The wheel 35 has started a complete rotation by preparing the traction spring 120 and thus by tensioning the chain 119. While the rotation of the fly wheel 41 continues (FIG 1), all punches 23 are applied on the movement belt 76, the erasure bar 59 reaches the position called "low."

After the flywheel 41 has completed about one half turn, the stop bar has pressed on the selection rods 24 which were in the selected position, thus on the punch heads 42 and only those punches will have perforated the movement belt 76, because the position of the stop bar 10 called "low" is not low enough for said stop bar to press on the heads 42 of the non-selected punches 23. The space remaining between the stop bar and the non-selected punch heads thus is greater than zero but smaller than the thickness of the selection rods 24 minus the thickness of the thinnest movement belt type 76 plus a factor of safety equal to the penetration of the punch into the die. The shaft 59 already commenced its upward movement.

With the rotation of the flywheel 41 continuing, the stop or stroke bar 10 primes an upward movement and releases the selection rods 24. The punch carrier plate 21 raises all punches 23 by their head 42. By friction of the punches in its perforations, the movement belt is raised slightly and arrives in a thrust against the punch guide plate 7 which then acts as extractor, and the movement belt is released. The bar 59 commences the erasure of the functions and arrives in the top position, all functions are then erased. The advancing process of the tape commences, the cam 36 (FIG. 9) meets the pivot 89 on its trajectory. With the aid of the ratchet wheel 94, the cog wheel 108 (FIG. 10) prepares the traction spring 110 and rotates by one or several teeth. When the lever 90 (FIG. 9) returns to its starting position, under the action of the traction spring 91, the tooth of the positioning lever 112 (FIG. 10) is engaged between two teeth of the cog wheel 108, the stroke bar 10 continues its ascent and the erasure bar commences to descend again.

When the tooth 123 again contacts the notch 122 (FIG. 10) of the serrated wheel, the swaging cycle is completed, the thrust bar is in the high position, the movement belt has advanced by one pitch and the apparatus is ready for a subsequent swaging cycle.

The machining of the die 6 is done directly on the swaging apparatus when it is first put into service. The die 6 is for example, a metal belt produced on the anvil 5 and initially it has no hole. With several swaging cycles, as described before, we stamp the die, for example, in 5 or 6 cycles, in which we punch each time one hole on 5 or 6, until the entire die is punched. The preparation of the die is made without the movement belt.

The swaging apparatus is thus prepared to perforate instructions on a movement tape necessary for the control of a knitting machine, for example.

A variant of the entrainment wheels 62, 63, 66, 67 may be the one shown in FIG. 11. The entrainment wheels 125, 126, 127, 128 of regular prismatic section, hexagonal in this example, are mounted on the same shafts 64, 65 in the place and stead of the entrainment wheels, 62, 63, 66, 67 of FIG. 8. They are embedded and interconnected, in pairs, by folded sheets 135, 136 of the same regular prismatic shape, so as to form two entrainment drums, and they possess tenons 139 which transmit the rotation movements to the movement cardboards 133, via openings 140 (FIG. 13*a*) placed in said movement cardboards. In the case of this variation, the feed system of FIG. 9 will be changed in that the stop screw 98 will be eliminated. Only the stop screw 99 remains. Thus, the cog wheel 108 (FIG. 10) will advance by two teeth. Safety rods 129, 130, 131, 132, similar to those already mentioned (68, 69, 70, 71) are mounted in place instead of the latter.

The hooking means 134 (FIG. 13*a* and FIG. 13*b*) of these movement cardboards 133 require a new shape of the punch guide plate 7 (FIG. 12) and of the die 6 to leave space at the passage of said hooking means which makes it possible to assemble movement cardboards to form movement tapes.

The knitting machine operator thus has in his hands a means which allows him by selection of the die, of the advance of the device, of the spacing of the entrainment wheels, of the kind and distribution of the functions of the keys of the keyboard, to prepare different types of movement belts. He also has the possibility of controlling the perforation before making it and he can do so by arranging selected and non-selected selectors at different levels of the keyboard.

What is claimed is:

1. An apparatus for swaging or punching a movement control belt or tape for the control of the operational groups of a knitting machine, comprising a punching bar, a die, punches, a punch bearing plate, entrainment means, a movement control tape, punch selection means and a selector keyboard, characterized by the fact that for each of the possible perforations arranged over at least one row of a movement control belt there is a punch which is free from any mechanical attachment, that a selector corresponds to each punch which may be pivoted on its axis of rotation into at least two positions which it maintains by memory means constituted by a spring-comb, each tooth of said spring comb acting on at least one of the selectors, that memorized selectors are cancelled individually and/or by operations, each function requiring one or more selectors, and/or totally by cancellation or erasure means which are manual, independent of a swaging cycle, and/or automatic depending on a swaging cycle, that a selection bar corresponds to each selector which materializes the selection, that all, part of, or none of the perforations constituting on a movement control tape, at least one group of functions and arranged on at least one row and over the entire length of the die and the punch holder, result from one single swaging cycle, that the step by step advance of a movement control belt during one swaging cycle is adjustable by entrainment means in at least two different sizes, that at least one of the entrainment means wheels is movable on a shaft, in at least two different positions allowing for the swaging or punching of at least two types of movement control belts of different widths, and that the posting of the keys making up the selector keyboard is identical for several types of movement control belts.

2. A punching apparatus according to claim 1, characterized by the fact that the axis of rotation of the selectors is thinned by the machining of two symmetrical and diametrically opposite sides, which permits an easy installation of the selectors.

3. A punching apparatus according to claim 1, characterized by the fact that the selection rods materializing the selection are curved at one end, permitting the hooking of each of these rods with each selector.

4. A punching apparatus according to claim 1, characterized by the fact that the erasure means of the memorized functions are tongs, each related to one or several of the teeth of a spring comb forming the memorization means.

5. A punching apparatus according to claim 4 whereby the tongues constituting the erasure means are controlled by a system of connecting rods mounted on eccentric cams of the control shaft of the punching or swaging cycle.

6. A punching apparatus according to claim 1, characterized by the fact that the matrix or die and the punch carrier plate have transverse grooves permitting the passage of assembly means of movement cardboards constituting the movement control tapes.

7. A punching apparatus according to claim 1, characterized by the fact that a cog wheel forming one piece with a shaft of the entrainment means positions, by means of a serrated lever, the positions of a movement control tape in relation to the die.

8. A punching apparatus according to claim 1, characterized by the fact that the entrainment means wheels are constituted by at least two cheek plates of regular prismatic shape, forming one piece with an entrainment shaft and wrapped by at least one bent sheet of the same regular prismatic shape, forming drums.

9. A punching apparatus according to claim 1, characterized by the fact that the selector keys of the memorized and non-memorized functions form at least two different planes on the keyboard, thus permitting a visual control of the memorized functions.

* * * * *